United States Patent [19]

Parker

[11] Patent Number: 4,527,833

[45] Date of Patent: Jul. 9, 1985

[54] HEAD REST ATTACHMENT

[76] Inventor: James J. Parker, 23011 Lita Place, Woodland Hills, Calif. 91364

[21] Appl. No.: 456,834

[22] Filed: Jan. 10, 1983

[51] Int. Cl.[3] ..... A47C 7/36

[52] U.S. Cl. ..... 297/397; 297/408

[58] Field of Search ..... 297/397–402, 297/408, 391

[56] References Cited

U.S. PATENT DOCUMENTS

| | | | |
|---|---|---|---|
| 48,270 | 6/1865 | Gates | 297/399 |
| 91,389 | 6/1869 | Weeden | 297/401 |
| 336,514 | 2/1886 | Ensling | 297/401 |
| 380,251 | 3/1888 | Dillon et al. | 297/401 |
| 711,259 | 10/1902 | Pickering | 297/399 |
| 3,244,389 | 4/1966 | Wilkins | 297/423 X |
| 3,245,715 | 4/1966 | Gits | 297/440 |
| 3,632,162 | 1/1972 | Trethaway | 297/397 |
| 4,030,781 | 6/1977 | Howard | 297/397 |

FOREIGN PATENT DOCUMENTS

| | | | |
|---|---|---|---|
| 1417128 | 10/1965 | France | 297/397 |

*Primary Examiner*—Francis K. Zugel

*Attorney, Agent, or Firm*—Poms, Smith, Lande & Rose

[57] ABSTRACT

A head rest attachment is provided for tubular frame lawn or patio furniture. The head rest attachment includes a curved head support surface, and a resilient adjustable clamp for attaching the supporting surface to the top of the back tubular member of the lawn or patio furniture so that a head supporting force is created along a line between the centers of the supporting surface and the tubular member. For added comfort the head support surface may be padded. Further, the head support surface may be concave and extend upwardly and laterally to provide lateral support and to prevent a person's head from rolling to the side, if the user should doze off.

5 Claims, 3 Drawing Figures

HEAD REST ATTACHMENT

FIELD OF THE INVENTION

This invention relates to head rests, and more particularly to head rest attachments for leisure type furniture, such as tubular patio or lawn furniture.

BACKGROUND OF THE INVENTION

Most lawn chairs are constructed with a tubular metal frame with canvas or plastic webbing extending between the frame members. Many of these lawn chairs have low backs that do not provide head support for a person using the chair. When relaxing or sleeping in the chair, the person's head will roll back or to the side into an uncomfortable position. Further, the person's head may rest against the metal frame member on the top of the chair back.

Accordingly, a principal object of the present invention is to provide a head rest attachment that will extend upwards from the top frame member of back of tubular type leisure furniture and give padded support to the user's head.

SUMMARY OF THE INVENTION

In accordance with one aspect of the present invention, a head rest attachment includes a head support surface, means for attaching the support surface to a frame member at the top of a lawn chair's back, and means for aligning the supporting surface and the attachment means so that a head supporting force is created along a line between the supporting surface and the tubular member. In addition, to provide more comfort, the supporting surface includes padding.

In accordance with another feature of the invention, the head supporting surface is concave to prevent the user's head from rolling to the side.

In accordance with additional aspects of the invention, the head rest attachment may be provided with a resilient U-shaped clamping member to fit over the top rail of the back of the leisure type furniture; and the head rest and clamp may be formed as a single moulded plastic part.

Other objects, features and advantages of the present invention will become apparent from a consideration of the following detailed description and from the accompanying drawings.

DETAILED DESCRIPTION

Figure 1:
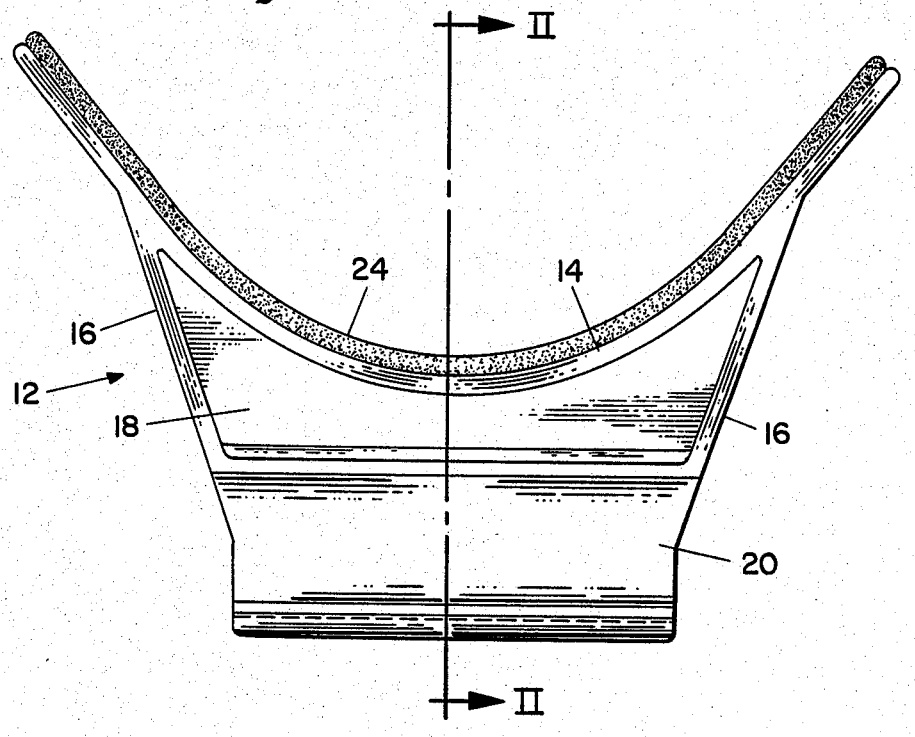
FIG. 1 is a front view of the head rest attachment.
Figure 2:
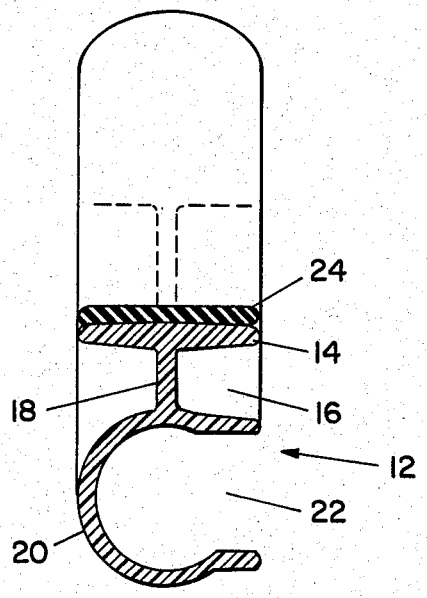
FIG. 2 is a cross-sectional view taken along section II—II of FIG. 1.

Referring more particularly to the drawings, FIGS. 1 and 2 show two views of the head rest attachment 12. A head rest 12 has a concave member 14 which is secured by side supports 16 and a central support 18 to a tubular clamping or attachment section 20. An opening 22 allows the attachment section 20 to snap into place around a frame member 30 of a lawn chair (See FIG. 3).

Foam padding 24 is shown affixed to the concave member 14. The padding 24 combined with the concave member 14 provide padded support for the user's head (See FIG. 3). In this embodiment, the padding 24 is glued to the concave member 14, but in other embodiments the padding 24 could be detachable. Alternatively, if desired several layers of towelling or the like could be laid over the concave member 14.

Figure 3:
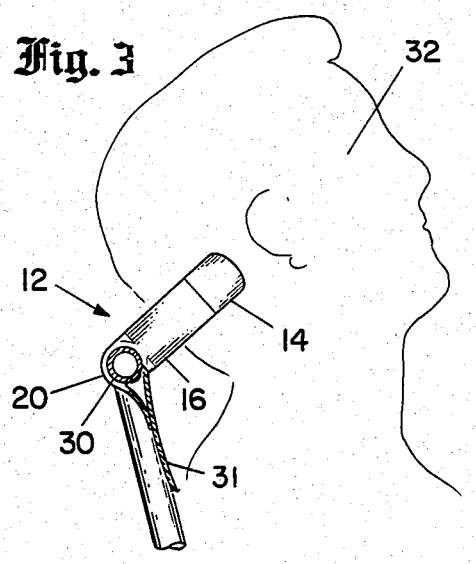
FIG. 3 is a side view of the head rest attachment in use on a tubular framed lawn chair.

FIG. 3 shows the head rest 12 attached and in use on a frame member 30 of a lawn chair. The attachment section 20 is affixed about the frame member 30 with the concave member 14 extending towards a user's head 32. The head rest 12 can be rotated about the frame member 30 so that the weight of the head 32 is supported along the line that passes through the center of the frame member 30. Also note that the concave construction of the member 14 will prevent the head 32 from rolling to the side.

It may also be noted that the U-shaped configuration of the clamping portion 20, with the open portion 22 extending to the front, permits easy assembly of the unit to a patio chair without interfering with the webbing 31 of the chair.

It may be noted that a line perpendicular to the center of the head supporting surface extends generally toward the center of the tubular frame member 30. This alignment allows that surface to support a person's head without creating a substantial torque at the tubular attachment section 20. Such a substantial torque might twist the head rest 12 about the frame member 30 and out from under the user's head.

Although the specific dimensions are not critical, the actual dimensions of one unit which is the presently preferred embodiment will now be given. The thickness of the entire unit is about one and one-quarter inches, and the inner diameter of the clamping element 20 is about one inch. The thickness of the plastic members is about one-tenth or one-eighth of an inch, with 0.10 inch and 0.12 inch actually being employed. The radius of the curved concave surface is approximately two and one-half inches, and the over-all dimensions of the head rest are about six inches wide at the top, about three inches wide at the clamp, and slightly less than four inches total height.

In conclusion, it is to be understood that the present invention is not limited to the precise structure as shown and described hereinabove. Thus, by way of example, and not of limitation, the tubular attachment section 20 could be replaced by straps or other attachment means; and instead of being padded, the head rest surface 14 of the unit may be made of semi-resilient material, providing both support and comfort without the need for padding 24. Also, the head rest of the invention is applicable to outdoor furniture such as the back rests used at the beach made of aluminum tubing, with canvas or other cloth backs and seats, for example. Further, the curved concave support surface could be replaced by a straight support surface or by a series of padded angularly related straight surfaces. Accordingly, the invention is not limited to the embodiment shown and described hereinabove.

What is claimed is:

1. A head rest attachment for the back of tubular framed outdoor type furniture having webbing extending up the front side of the back of the furniture, comprising:

a head support member, having a padded concave head engaging surface, clamping means for snapping onto and engaging a top back member of said tubular framed outdoor type furniture to hold said head support member in selected different angular orientations;

said clamping means comprising a resilient tubular section opening toward the front of said attachment, whereby it may be attached to a tubular frame, with said head rest angled forward without interfering with webbing material secured to said tubular frame;

said tubular section having an inner diameter dimensioned to make a tight fit on the upper back portion of said furniture, and having an opening of a slightly smaller dimension than said inner diameter to permit limited rotation while gripping the top rear portion of said furniture, and support structure means for interconnecting and aligning said head support member and said clamping means to permit a head supporting force to be created along the line between the centers of said support structure and the top back tubular member, whereby the forces tending to rotate said head rest attachment relative to the top back tubular member are minimized.

2. A head rest attachment as defined in claim 1 wherein the head support member, the clamping means and the support structure means are formed of a single moulded plastic part.

3. A head rest attachment as defined in claim 1 wherein said attachment is between four and eight inches in lateral extent.

4. A head rest attachment as defined in claim 1 wherein said tubular section is generally circular and has an inner diameter of about one inch.

5. A head rest attachment as defined in claim 1 wherein the overall height of said attachment is between two and six inches.

* * * * *